US010400657B2

(12) United States Patent
Bischofberger et al.

(10) Patent No.: US 10,400,657 B2
(45) Date of Patent: Sep. 3, 2019

(54) PISTON FOR AN INTERNAL COMBUSTION ENGINE AND COVER PLATE FOR A PISTON

(71) Applicant: Mahle International GmbH, Stuttgart (DE)

(72) Inventors: Ulrich Bischofberger, Esslingen (DE); Harald R. Mueller, Ostfildern (DE)

(73) Assignee: Mahle International GmbH (DE)

( * ) Notice: Subject to any disclaimer, the term of this patent is extended or adjusted under 35 U.S.C. 154(b) by 51 days.

(21) Appl. No.: 15/033,642

(22) PCT Filed: Oct. 28, 2014

(86) PCT No.: PCT/EP2014/002901
§ 371 (c)(1),
(2) Date: Apr. 30, 2016

(87) PCT Pub. No.: WO2015/062719
PCT Pub. Date: May 7, 2015

(65) Prior Publication Data

US 2016/0298523 A1 Oct. 13, 2016

(30) Foreign Application Priority Data

Oct. 30, 2013 (DE) ..... 10 2013 018 249

(51) Int. Cl.
*F01P 3/08* (2006.01)
*F02F 3/22* (2006.01)
*F02F 3/00* (2006.01)

(52) U.S. Cl.
CPC ..... *F01P 3/08* (2013.01); *F02F 3/0084* (2013.01); *F02F 3/22* (2013.01)

(58) Field of Classification Search
CPC .... F01P 3/08; F01P 1/04; F02F 3/0084; F02F 3/22
See application file for complete search history.

(56) References Cited

U.S. PATENT DOCUMENTS 1,995,746 A 3/1935 Nelson
4,505,233 A * 3/1985 Kanda ..... F01P 3/10 123/193.6

(Continued)

FOREIGN PATENT DOCUMENTS

DE 4208037 A1 9/1993
DE 19522756 A1 1/1997
DE 102011013139 A1 9/2012

OTHER PUBLICATIONS

English abstract for DE-19522756.
German search report for DE-102013018249.2, dated Nov. 19, 2014.

*Primary Examiner* — Joseph J Dallo
*Assistant Examiner* — Kurt Philip Liethen
(74) *Attorney, Agent, or Firm* — Fishman Stewart PLLC

(57) ABSTRACT

A piston for an internal combustion engine may include a piston head and a piston skirt. The piston skirt may include piston bosses disposed opposite one another having a boss bore and at least two shank walls disposed opposite one another having a running surface. A cover plate including a recess for receiving a connecting rod may be secured in a lower region of the piston skirt. The cover plate may have at least two longitudinal sides disposed opposite one another and at least two free ends disposed opposite one another. At least two grooves may be arranged in the lower region of the piston skirt on the at least two shank walls. The at least two free ends of the cover plate may be accommodated resiliently prestressed in the at least two grooves.

16 Claims, 4 Drawing Sheets

(56) References Cited

U.S. PATENT DOCUMENTS

| | | | | |
|---|---|---|---|---|
| 4,506,632 | A * | 3/1985 | Kanda | F01M 1/08<br>123/193.6 |
| 5,261,363 | A | 11/1993 | Kemnitz | |
| 6,701,875 | B2 * | 3/2004 | Weng | F01P 3/08<br>123/193.6 |
| 7,628,134 | B2 * | 12/2009 | Scharp | F02F 3/22<br>123/193.6 |
| 2003/0221639 | A1 * | 12/2003 | Weng | F01P 3/08<br>123/41.35 |
| 2007/0181089 | A1 | 8/2007 | Ishimitsu et al. | |
| 2012/0022632 | A1 | 1/2012 | Hoffman et al. | |
| 2012/0222632 | A1 * | 9/2012 | Scharp | F02F 3/003<br>123/41.37 |

* cited by examiner

PISTON FOR AN INTERNAL COMBUSTION ENGINE AND COVER PLATE FOR A PISTON

CROSS-REFERENCE TO RELATED APPLICATIONS

This application claims priority to German Patent Application No. 10 2013 018 249.2, filed Oct. 30, 2013, and International Patent Application No. PCT/EP2014/002901, filed Oct. 28, 2014, the contents of which are hereby incorporated by reference in their entirety.

TECHNICAL FIELD

The present invention relates to a piston for an internal combustion engine, having a piston head and a piston skirt, wherein said piston skirt has piston bosses located opposite one another with boss bores, as well as shank walls located opposite one another with running surfaces, wherein a cover plate with a recess for the passage of a connecting rod is fastened in the lower region of the piston. The present invention also relates to such a cover for a piston.

BACKGROUND

A piston of the type in question with spray cooling is known from the Austrian utility model document AT 001 919 U1. Said piston has a retention plate arranged in the lower region thereof, which is fastened to the piston by means of screwing, soldering, riveting, welding or press-fitting. The oil sprayed into the piston from below is initially used for cooling in the cooling channel and then employed for cooling the combustion chamber floor and for lubricating the small connecting-rod eye. The shaker effect causes an oil mist to form, which ensures a corresponding cooling effect.

The German laid-open application DE 195 22 756 A1 discloses a piston with a channel-shaped sheet-metal part circulating the interior of the piston skirt arranged in the lower region of said piston.

SUMMARY

The object of the present invention is to develop a piston of the type in question as well as a cover plate of the type in question in such a way that the cover plate is fastened as securely and as captively as possible on the piston.

The problem is solved in that the cover plate has two longitudinal sides located opposite one another and two free ends located opposite one another, and in that grooves are provided in the lower region of the shank walls, in which grooves the free ends of the cover plate are accommodated under resilient prestress.

The cover plate according to the invention is distinguished in that a moulding, designed in a spring-elastic manner and u-shaped or v-shaped in cross-section, is provided between the recess and at least one of the free ends.

According to the invention, it is provided that the cover plate is retained on the piston under resilient prestress. This renders the need for complicated fastening measures, such as screwing, soldering, riveting, welding or press-fitting, superfluous.

The cover plate provided according to the invention collects back-flowing cooling oil and delays or prevents the discharge thereof in the direction of the crankshaft. The cooling oil can be introduced directly into the interior of the piston above the cover plate by means of an oil spray nozzle or flow out of a cooling channel, if available, into the interior of the piston. The shaker effect occurring when the motor is in operation causes the cooling oil collected by the cover plate to move back and forth at a high frequency in the direction of the boss bores and of the piston head, thus resulting in a better cooling effect.

It has been determined in measurements that the operating temperature of the piston head, of the annular grooves and of the boss bores can be significantly reduced. In comparison with operating temperatures of 200° C. to 220° C. for pistons according to prior art, the operating temperatures in pistons according to the invention were reduced by up to 30%.

The cover plate provided according to the invention also allows improved cooling of the shank walls, as the collected cooling oil in the region of the shank walls, i.e. between a free end and the central recess in each case, is accumulated and the improved cooling effect generated by the shaker effect is increasingly present in the region of the shank walls.

Advantageous further developments result from the dependent claims.

A particularly preferred embodiment is that a moulding, designed in a spring-elastic manner and u-shaped or v-shaped in cross-section, is provided between the recess and at least one of the free ends of the cover plate. Said moulding functions as a spring-elastic element serving to retain the cover plate provided according to the invention particularly securely on the piston under resilient prestress. Furthermore, the prestressing force of the cover plate can be regulated by means of the axial depth of the moulding. This allows the prestressing force of the cover plate to be adapted to various piston types and piston sizes and the range of possible uses thereof to be widened. The moulding also effects that a retention chamber for cooling oil is formed between said moulding and the free end or shank wall assigned thereto. This further improves in particular the cooling of the shank walls.

The moulding practically runs parallel to the free end assigned thereto. This maximum spring-elastic effect of the moulding can be achieved as a result.

An advantageous further development is to provide the cover plate with at least one latching element at each of the longitudinal sides thereof assigned to the piston bosses, said latching element engaging behind a lug provided on the piston under resilient prestress, thus causing a tongue-and-groove connection according to a type of clip, which constitutes additional position-securing for the cover plate according to the invention on the piston.

The entire cover plate is preferably made of a spring-elastic material, in order to facilitate the insertion of the cover plate in the grooves.

Should the piston according to the invention be employed in a motor with spray cooling, the cover plate has a recess in the region of the shank wall of the piston, in order to allow the passage of cooling oil.

Should the piston according to the invention be additionally provided with a circulating cooling channel with at least one supply opening for cooling oil, it is advantageous if the recess with the at least one supply opening is formed in alignment. In such case, the cooling channel can also be supplied with cooling oil by the oil spray nozzle.

The cover plate is preferably configured in a curved manner at least along sections of the longitudinal sides thereof. This facilitates the insertion of the cover plates in the grooves of the shank walls and also allows a further control of the spring-elastic prestressing force. Ultimately, the curved configuration effects that a retention chamber for cooling oil is formed between the recess and the free end or the shank wall, thus in particular further improving the cooling of the shank walls.

The present invention is in particular suitable for pistons of a low compression height. Steel or light metal pistons, with or without cooling channels, can thereby be involved. A preferred area of application are pistons made of an aluminium-based material without cooling channel, as described in the German laid-open application DE 41 10 306 A1, for example.

BRIEF DESCRIPTION OF THE DRAWINGS

The exemplary embodiment of the present invention is explained in more detail in the following on the basis of the enclosed drawings. The figures show schematically, and not true to scale.

DETAILED DESCRIPTION

Figure 1A:
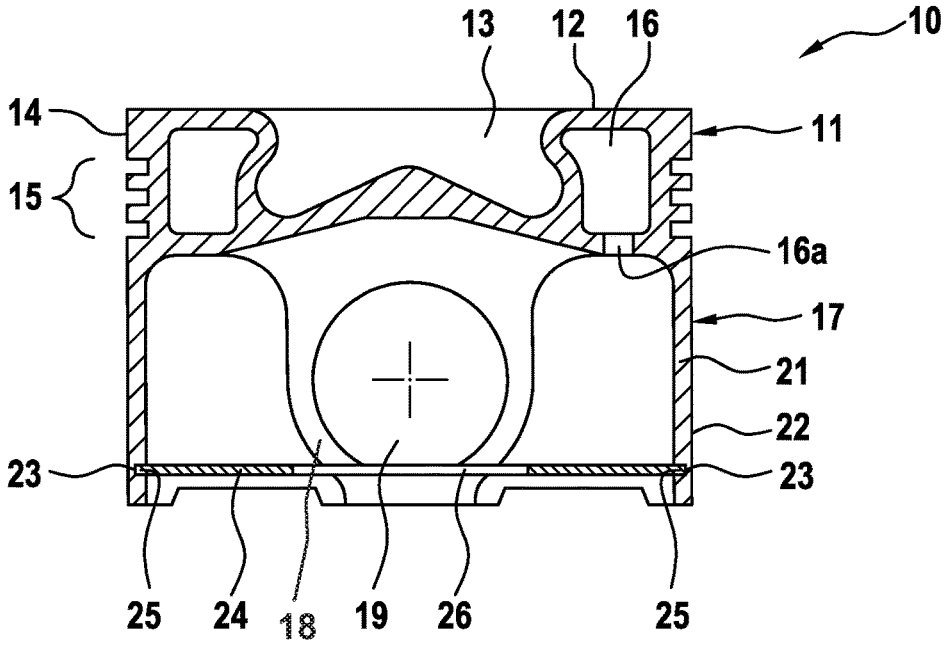
FIG. 1A an exemplary embodiment of a cooling channel piston according to the invention with a schematically indicated cover plate.
Figure 1B:
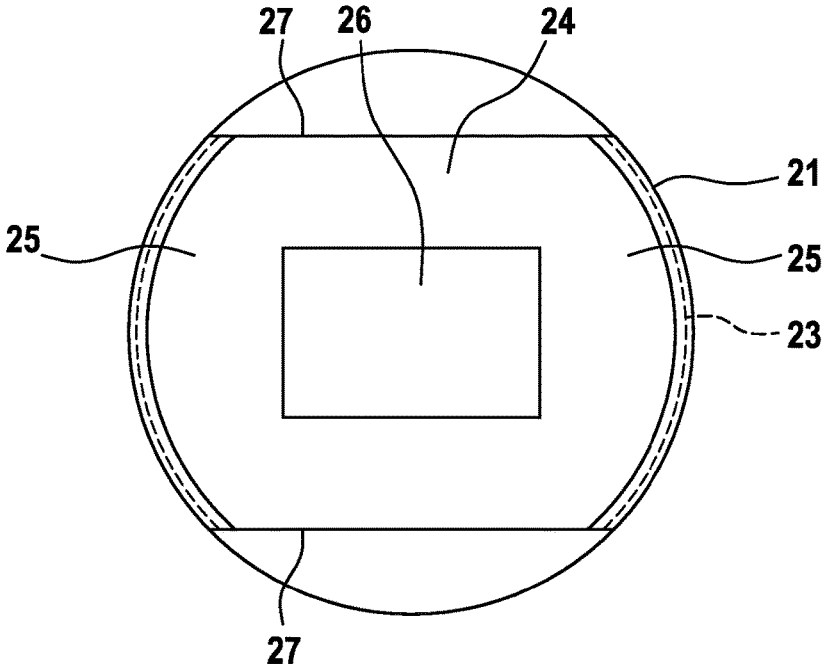
FIG. 1B the pistons according to FIG. 1A or FIG. 1C in a bottom view.
Figure 1C:
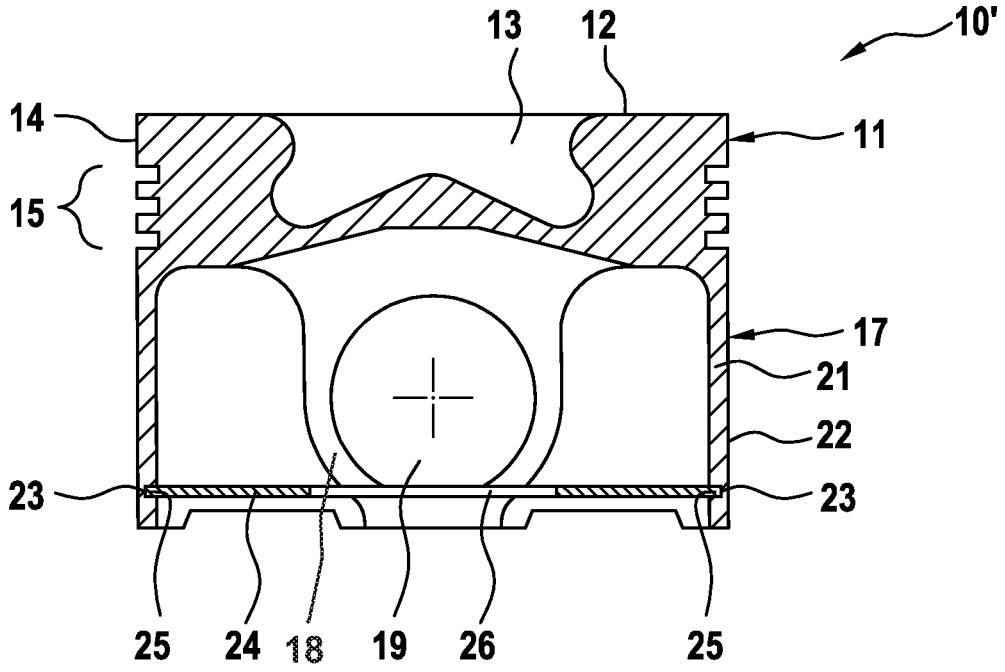
FIG. 1C an exemplary embodiment of a piston according to the invention without cooling channel with schematically indicated cover plate.

FIGS. 1*a*, 1*b* and 1*c* show two exemplary embodiments of a piston 10, 10' according to the invention. Said piston 10, 10' can be made of a steel material or of a light metal material, in particular of an aluminium-based alloy. The piston 10, 10' preferably has a low compression height (e.g. 0.27 to 0.40). The only difference between the two exemplary embodiments is that the piston 10 according to FIG. 1*a* has a cooling channel, whereas the piston 10' according to FIG. 1*c* does not.

The pistons 10, 10' in the exemplary embodiment are each configured as one-piece box pistons. Said pistons 10, 10' have a piston head 11 and a piston skirt 17 in a manner known per se. The piston head 11 has a piston base 12, a combustion bowl 13, a circulating fire land 14 and a circulating ring part 15 with annular grooves for piston rings (not illustrated). A circulating cooling channel 16 is provided at the level of the ring part 15, said cooling channel 16 having at least one supply opening 16*a* for cooling oil. The piston skirt 17 has piston bosses 18 located opposite one another with boss bores 19 for accommodating a piston pin (not illustrated). Said piston bosses 18 are connected with each other in a manner known per se via running surfaces 22 having shank walls 21 located opposite one another.

As indicated in FIG. 1*a* to FIG. 1*c*, a cover plate 24 is provided in the lower region of the shank walls 21. Particularly evident in FIG. 1*b* is the fact that grooves 23 are provided in the lower region of the shank walls 21; said grooves 23 being shown in dashed lines in FIG. 1*b* and accommodating the free ends 25 of the cover plate 24 under resilient prestress. The cover plate 24 has a recess 26, which serves to allow the passage of a piston rod when the motor is in operation. The cover plate 24 also has two longitudinal sides 27 assigned to the piston bosses 18. In order to achieve an optimally improved cooling effect, the cover plate 24 should cover the largest possible region of the underside of the piston 10 or 10'.

Figure 2:
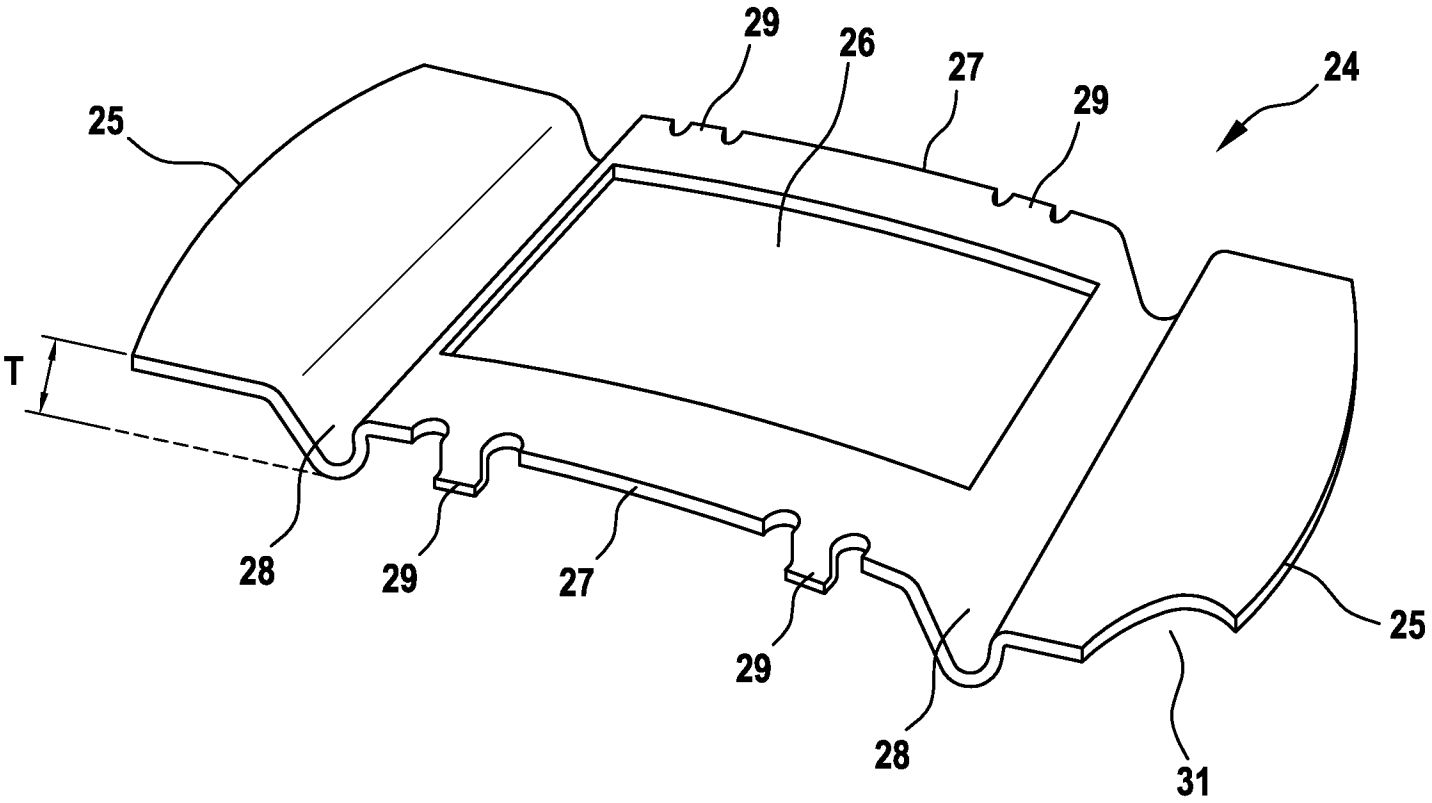
FIG. 2 an exemplary embodiment of a cover plate according to the invention.

FIG. 2 shows an exemplary embodiment of a cover plate 24 according to the invention. Said cover plate 24 is made of a spring-elastic material in the exemplary embodiment, is overall slightly curved in configuration and has two longitudinal sides 27 located opposite one another and two free ends 25 located opposite one another. An approximately concentric recess 26 is also provided to allow the passage of a piston rod when the motor is in operation.

A moulding 28, designed in a spring-elastic manner and u-shaped or v-shaped in cross-section, is provided in the exemplary embodiment between the recess 26 and each of the free ends 25 of the cover plate 24. Each of such mouldings 28 in the exemplary embodiment runs substantially parallel to the free ends 25 assigned thereto and has the effect of a spring-elastic element, which serves to retain the cover plate 24 particularly securely on the piston 10 under resilient prestress. Each moulding 28 has a defined axial depth T. Said axial depth T of the moulding 28 allows the mobility of the free ends 25 to be regulated in the longitudinal direction, i.e. parallel to the longitudinal sides 27. The larger the axial depth T, the more moveable are the free ends 25 of the cover plate 24.

The cover plate 24 in the exemplary embodiment is provided with precisely two latching elements 29 on each of the longitudinal sides 27 thereof, said latching elements 29 being of a substantially s-shaped configuration in cross-section. The latching elements 29 are also configured spring-elastically.

Should the cover plate 24 be provided for a piston for use in a motor with spray cooling, said cover plate 24 comprises a recess 31 in the region of one of the free ends thereof, in order to allow the passage of cooling oil when the motor is in operation.

Figure 3:
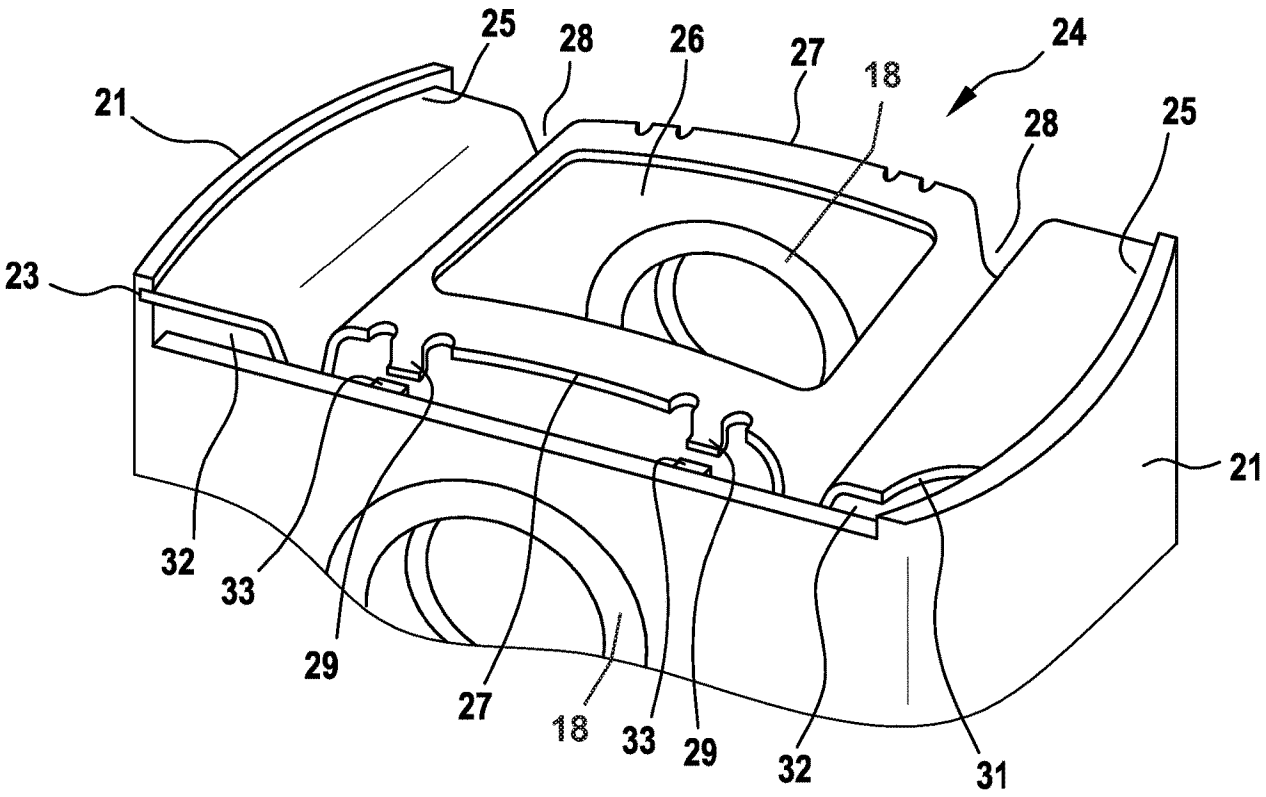
FIG. 3 the cover plate according to FIG. 2, partially installed in a piston according to FIG. 1.

FIG. 3 shows the lower region of a piston 10 according to FIG. 1 or 10' according to FIG. 1*c* with cover plate 24 incompletely inserted in the piston 10 or 10' according to FIG. 2 in an exemplary manner. Continuous grooves 23 are provided in the lower area of the shank walls 21 in the exemplary embodiment. Said grooves 23 accommodate the free ends 25 of the cover plate 24 under resilient prestress. To this end, at least one section of the cover plate 24 needs to be of a spring-elastic configuration or made of a spring-elastic material by means of production, wherein a curved configuration of the cover plate 24 along the longitudinal sides 27 can have a supportive effect.

The spring-elastic design of the cover plate 24 in the exemplary embodiment predominantly ensues due to the spring-elastically configured mouldings 28. In order to assemble the cover plate 24 in the grooves 23 of the shank walls 21, the free ends 25 are moved in longitudinal direction and in the direction of the recess 26, whereby the mouldings 28 yield. Once the cover plate 24 is located in the desired position relative to the grooves 23, the free ends 25 are released and snap into the grooves 23. The cover plate 24 is thus fixed in the piston 10 or 10'. The axial depth T of the mouldings 28 hereby influences the spring-elastic prestressing force, under which the cover plate 24 is retained in the piston 10 or 10'. The smaller the axial depth T, the larger is the resulting prestressing force.

The mouldings 28 with the shank walls 21 assigned thereto form a retention chamber 32 for cooling oil. By this in particular the cooling of the shank walls 21 is further improved.

In order to achieve additional position-securing of the cover plate 24 in the piston, lugs 33 are provided in the region of the piston bosses 18, said lugs 33 corresponding to the latching elements 29 located on the longitudinal sides 27 of the cover plate 24. If the cover plate 24 is completely inserted in the piston 10 or 10', the latching elements 29 engage behind their corresponding lugs 33, thus forming a clip-like tongue-and-groove snap connection (not illustrated in FIG. 3).

The recess 31 in the exemplary embodiment is substantially arranged in alignment with the supply opening 16*a* in the cooling channel 16, thus allowing the latter to be supplied with cooling oil as well.

The cover plate 24 provided according to the invention collects back-flowing cooling oil and delays the discharge thereof in the direction of the crankshaft. The shaker effect occurring when the motor is in operation causes the cooling oil collected by the cover plate 24 to move back and forth at a high frequency in the direction of the boss bores 19 and of the piston head 11, thus resulting in a better cooling effect, particularly in the region of the shank walls 21, as the collected cooling oil accumulates in this region.

The invention claimed is:

1. A piston for an internal combustion engine, comprising:

a piston head and a piston skirt together defining a reciprocating axis, wherein said piston skirt includes piston bosses disposed opposite one another having a boss bore, and at least two shank walls disposed opposite one another having a running surface;

a cover plate including a recess for receiving a connecting rod secured in a lower region of the piston skirt, the cover plate having two longitudinal sides disposed opposite one another structured and arranged to interact with the piston bosses, and two free ends disposed opposite one another in a longitudinal direction of the cover plate structured and arranged to interact with the at least two shank walls, wherein the cover plate includes at least one latching element disposed on each of the two longitudinal sides;

at least two annular grooves arranged in the lower region of the piston skirt on the at least two shank walls, and at least two lugs provided in a region of the piston bosses, wherein the two free ends of the cover plate are accommodated resiliently prestressed in the at least two annular grooves, and the at least one latching element disposed on each of the two longitudinal sides engages a corresponding one of the at least two lugs;

the cover plate further including a spring-elastic moulding arranged between the recess and at least one free end of the two free ends, the spring-elastic moulding having a curved shape protruding axially outwards from the cover plate towards the piston head with respect to the reciprocating axis, wherein the curved shape of the spring-elastic moulding defines a u-shaped or v-shaped cross-section; and wherein the cover plate is secured to the piston skirt at a first mechanical prestressed connection between the two free ends and the at least two annular grooves where the at least two free ends are resiliently prestressed in the longitudinal direction, and a second mechanical prestressed connection between the at least one latching element on each of the two longitudinal sides and the corresponding one of the at least two lugs.

2. The piston according to claim 1, wherein the spring-elastic moulding extends transversely along the cover plate from one of the two longitudinal sides to the other of the two longitudinal sides and parallel to the at least one free end.

3. The piston according to claim 1, wherein the cover plate is composed of a spring-elastic material.

4. The piston according to claim 1, further comprising another recess disposed in the cover plate in a region of at least one of the at least two shank walls.

5. The piston according to claim 4, wherein the piston head includes a circulating cooling channel having at least one supply opening for cooling oil, and wherein the other recess is arranged in alignment with the at least one supply opening.

6. The piston according to claim 1, wherein the cover plate is configured in a curved manner at least along a section of the two longitudinal sides.

7. The piston according to claim 1, further comprising a second spring-elastic moulding arranged between the recess and a second free end of the two free ends of the cover plate.

8. The piston according to claim 2, wherein the curved shape of the spring-elastic moulding defines a predefined axial depth from a top of the u-shaped or v-shaped cross-section positioned axially towards the piston head to the at least one free end and provides a retention chamber for cooling oil defined between the spring-elastic moulding and a corresponding one of the at least two shank walls receiving the at least one free end.

9. The piston according to claim 1, wherein the cover plate has a second recess defined along an outer edge of the cover plate at a corner where the at least one free end meets one of the two longitudinal sides, and wherein the second recess is disposed between the spring-elastic moulding and the at least one free end in the longitudinal direction of the cover plate.

10. A cover plate for coupling to a shank wall of a piston having a reciprocating axis for a combustion engine, comprising:

a body having two longitudinal sides disposed opposite one another and two free ends disposed opposite one another in a longitudinal direction of the body, and a central recess for receiving a piston rod;

a spring-elastic moulding arranged between the central recess and at least one free end of the two free ends in the longitudinal direction, the spring-elastic moulding having a curved shape protruding axially outwards from the body with respect to the reciprocating axis that defines a u-shaped or v-shaped cross-section;

a second recess disposed in a region of the at least one free end, the second recess defined along an outer edge of the body at a corner where the at least one free end meets one of the two longitudinal sides, wherein the second recess is disposed between the spring-elastic moulding and the at least one free end in the longitudinal direction of the cover plate; and wherein the at least one free end is extended outwardly from the spring-elastic moulding in the longitudinal direction of the body such that the spring-elastic moulding has a predefined axial depth from an axially elevated top of the u-shaped or v-shaped cross-section to the at least one free end with respect to the reciprocating axis, and wherein the moulding extends transversely along the body from one of the two longitudinal sides to the other of the two longitudinal sides and parallel to the at least one free end.

11. The cover plate according to claim 10, further comprising at least one latching element of a spring-elastic configuration disposed on each of the two longitudinal sides.

12. The cover plate according to claim 10, wherein the body is composed of a spring-elastic material.

13. The cover plate according to claim 10, further comprising a second spring-elastic moulding arranged between the central recess and a second free end of the two free ends.

14. The cover plate according to claim 10, wherein the two longitudinal sides have a section defining a curved shape.

15. A piston having a reciprocating axis of an internal combustion engine, comprising:

a piston head and a piston skirt, the piston skirt including at least two piston bosses disposed opposite one another having a boss bore and at least two shank walls disposed opposite one another having a running surface;

a cover plate secured in a lower region of the piston skirt, the cover plate having a recess for receiving a connecting rod, at least two longitudinal sides extending in a longitudinal direction of the cover plate disposed opposite one another and structured and arranged to interact with the at least two piston bosses, and at least two free ends disposed opposite one another structured and arranged to interact with the at least two shank walls, the at least two free ends extending transversely to the longitudinal direction of the cover plate;

the piston skirt further including at least two annular grooves arranged in the lower region on the at least two shank walls and at least two lugs disposed in a region of the at least two piston bosses, wherein the at least two free ends of the cover plate engage resiliently prestressed in a corresponding one of the at least two annular grooves;

the cover plate including a spring-elastic moulding disposed between the recess and at least one free end of the at least two free ends, the spring-elastic moulding having a curved shape protruding axially outwards from the cover plate towards the piston head with respect to the reciprocating axis that defines a u-shaped or v-shaped cross-section with a predefined axial depth defined by an axial distance from an axially elevated top of the u-shaped or v-shaped cross-section to the at least one free end, wherein the at least one free end is extended outwardly from the spring-elastic moulding in the longitudinal direction of the cover plate;

the cover plate further including at least one latching element disposed on each of the at least two longitudinal sides, the at least one latching element engaging a corresponding one of the at least two lugs under resilient prestress;

wherein at least one of the spring-elastic moulding is composed of a spring-elastic material and the cover plate is composed of a spring-elastic material; and wherein the cover plate is secured to the piston skirt at a first mechanical prestressed connection between the at least two free ends and the corresponding one of the at least two annular grooves where the at least two free ends are resiliently prestressed in the longitudinal direction, and a second mechanical prestressed connection between the at least one latching element on each of the least two longitudinal sides and the corresponding one of the at least two lugs.

16. The piston according to claim 15, wherein the cover plate has a second recess defined along an outer edge of the cover plate at a corner where one of the at least two longitudinal sides meets the at least one free end having the spring-elastic moulding, and wherein the second recess is disposed between the spring-elastic moulding and the at least one free end in the longitudinal direction of the cover plate.

* * * * *